US008100654B1

(12) United States Patent
Liang

(10) Patent No.: US 8,100,654 B1
(45) Date of Patent: Jan. 24, 2012

(54) TURBINE BLADE WITH IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 404 days.

(21) Appl. No.: 12/463,914

(22) Filed: May 11, 2009

(51) Int. Cl.
*F01D 5/08* (2006.01)
*F01D 5/20* (2006.01)

(52) U.S. Cl. ..... 416/97 R

(58) Field of Classification Search ..... None
See application file for complete search history.

(56) References Cited

U.S. PATENT DOCUMENTS 7,597,540 B1 * 10/2009 Liang ..... 416/97 R

* cited by examiner

*Primary Examiner* — Ha Tran T Nguyen
*Assistant Examiner* — Valerie N Brown
(74) *Attorney, Agent, or Firm* — John Ryznic

(57) ABSTRACT

A turbine blade with a spar to support a thin thermal skin for the outer airfoil surface. The spar includes multiple rows of impingement cooling cavities that are each connected in series through curved impingement cooling holes to provide cooling for the airfoil walls. The spar is hollow on the inside and open at the blade tip with a blade tip rail extending along both walls and around the leading edge. The impingement cooling cavities discharge the spent cooling air through the tip cooling holes. A thin thermal skin is bonded to the spar to form the outer airfoil walls and is cooled by the series of impingement cooling cavities to provide a low metal temperature using a low volume of cooling air. The impingement cooling cavities and the curved impingement cooling holes are formed in the cast spar by drilling or machining so that a ceramic core for the cooling holes and cavities are not needed and blade casting yield is improved.

17 Claims, 4 Drawing Sheets

View A-A

TURBINE BLADE WITH IMPINGEMENT COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine rotor blade.

2. Description of the Related Art Including Information Disclosed Under 37 CFR 1.97 and 1.98

A gas turbine engine, such as an industrial gas turbine (IGT) engine, includes a turbine with multiple rows or stages or stator vanes that guide a high temperature gas flow through adjacent rotors of rotor blades to produce mechanical power and drive a bypass fan, in the case of an aero engine, or an electric generator, in the case of an IGT. In both cases, the turbine is also used to drive the compressor.

It is well known in the art of gas turbine engine design that the efficiency of the engine can be increased by passing a higher gas flow temperature through the turbine. However, the turbine inlet temperature is limited by the material properties of the turbine, especially for the first stage airfoils since these are exposed to the highest temperature gas flow. As the gas flow passes through the various stages of the turbine, the temperature decreases as the energy is extracted by the rotor blades.

Another method of increases the turbine inlet temperature is to provide more effective cooling of the airfoils. Complex internal and external cooling circuits or designs have been proposed using a combination of internal convection and impingement cooling along with external film cooling to transfer heat away from the metal and form a layer of protective air to limit thermal heat transfer to the metal airfoil surface. However, since the pressurized air used for the airfoil cooling is bled off from the compressor, this bleed off air decreases the efficiency of the engine because the work required to compress the air is not used for power production. It is therefore wasted energy as far as producing useful work in the turbine.

One method of maintaining a relatively low metal temperature for a turbine airfoil is to use a thin outer airfoil surface so that the heat transfer rate from the hot outer surface to the cooler inner surface is high. With a thin airfoil wall and a high heat transfer rate, the outer airfoil surface will have a lower metal temperature than would a relatively thick airfoil wall. A thicker wall is desired in order to provide for a rigid and structurally sound airfoil. Thin airfoil walls require support. An airfoil wall with a lower metal temperature requires less cooling air flow and thus will improve the turbine efficiency.

The U.S. Pat. No. 5,702,232 issued to Moore on Dec. 30, 1997 and entitled COOLED AIRFOIL FOR A GAS TURBINE ENGINE discloses an airfoil with a near wall cooling in the mid-chord section constructed with radial flow channels plus re-supply holes in conjunction with film discharge cooling holes, and is shown in FIG. 1. In the Moore design, the spanwise (radial direction) and chordwise (perpendicular to the radial direction) cooling flow control due to the airfoil external hot gas temperature and pressure variation is difficult to achieve. This is important since some surfaces of the outer airfoil are at higher metal temperatures than other surfaces, and thus require more cooling to control the overall metal temperature of the airfoil. In addition, a single radial channel flow is not the best method of utilizing the cooling air resulting in a low convective cooling effectiveness. The dimension for the airfoil external wall has to fulfill the casting requirement. an increase in the conduction path will reduce the thermal efficiency for the blade mid-chord section cooling. The blade leading edge and trailing edge sections are cooled with conventional cooling methods.

BRIEF SUMMARY OF THE INVENTION

It is an object of the present invention to provide for an air cooled turbine blade with a low metal temperature compared to the prior art blades.

It is another object of the present invention to provide for an air cooled turbine blade that can be formed with cooling air passages that do not require casting with the use of a ceramic core.

It is another object of the present invention to provide for an air cooled turbine blade with multiple impingement cooling cavities that can be selectively designed for cooling based upon the airfoil metal temperature and external pressure profile of the airfoil.

It is another object of the present invention to provide for an air cooled turbine blade that includes a thin thermal skin for the outer airfoil surface.

These objectives and more can be achieved by the air cooled turbine rotor blade of the present invention which is formed from a support spar that is cast and then the impingement cooling cavities and impingement cooling holes are drilled or formed into the cast spar. A thin thermal skin in a range of 0.010 inches to 0.030 inches thick is then bonded to the spar to form the outer airfoil surface for the blade assembly. The spar includes a series of separate impingement cavities that extend from the leading edge to the trailing edge of the airfoil and from the platform section to the tip section to cover the entire airfoil surface on the pressure side and the suction side. Each impingement cavity is connected to the adjacent cavities located above and below through a plurality of curved impingement cooling holes. The blade includes an open mid-chord hollow cavity.

Cooling air is supplied to a root cavity and then to the spanwise rows of impingement cavities to flow in series from the lower most impingement cavity near the platform to the impingement cavity at the blade tip, and then discharged through tip cooling holes to provide a series of near wall impingement cooling for the section of the airfoil. Film cooling holes are used on the pressure side wall and even on the suction side wall that connect to certain impingement cavities to address airfoil hot spot location cooling not shown in the present application.

A row of impingement cavities is also used along the leading edge and the trailing edge with curved impingement cooling holes that connect adjacent impingement cavities to form the series of impingement cooling from platform to the tip.

DETAILED DESCRIPTION OF THE INVENTION

The present invention is a turbine rotor blade for use in an industrial gas turbine engine with a support spar and a thin thermal skin bonded to the spar to form the outer airfoil surface. However, the blade with the cooling circuit of the present invention can be used for an aero engine and for a stator vane. The blade of the present invention formed with a main support spar that is cast without the impingement cavities or the curved impingement holes during the casting process. These features are formed later by drilling and machining.

Figure 1:
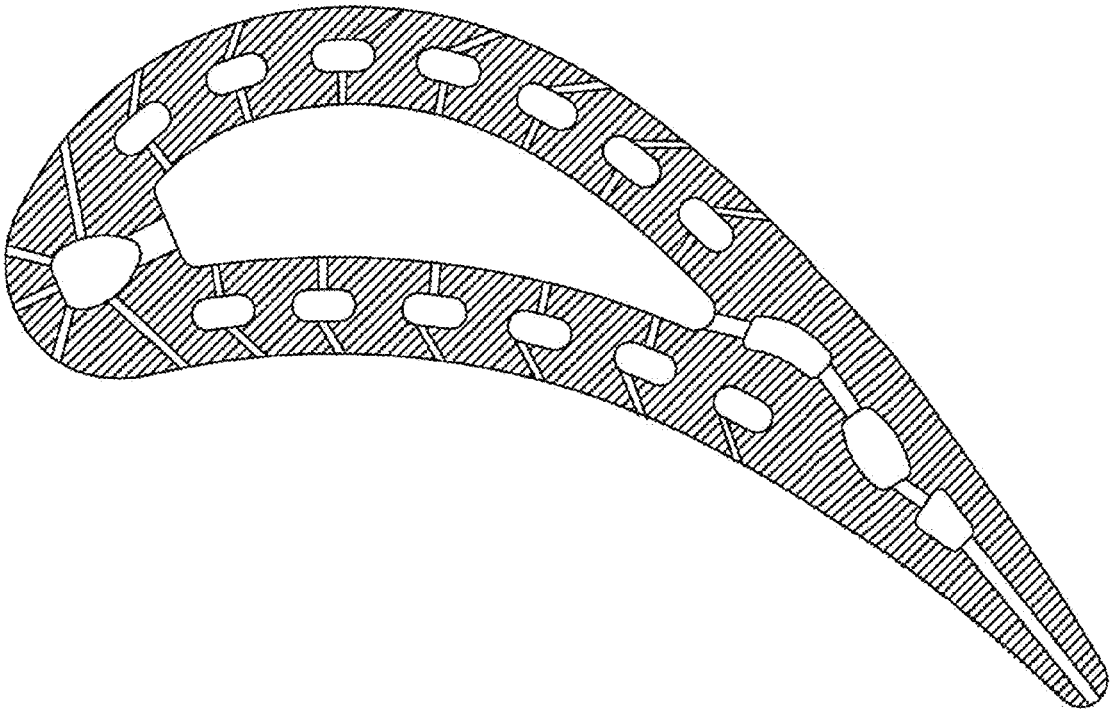
Fig 1 Prior Art
FIG. 1 shows a cross section top view of a prior art turbine blade with near wall cooling for the airfoil walls.
Figure 2:
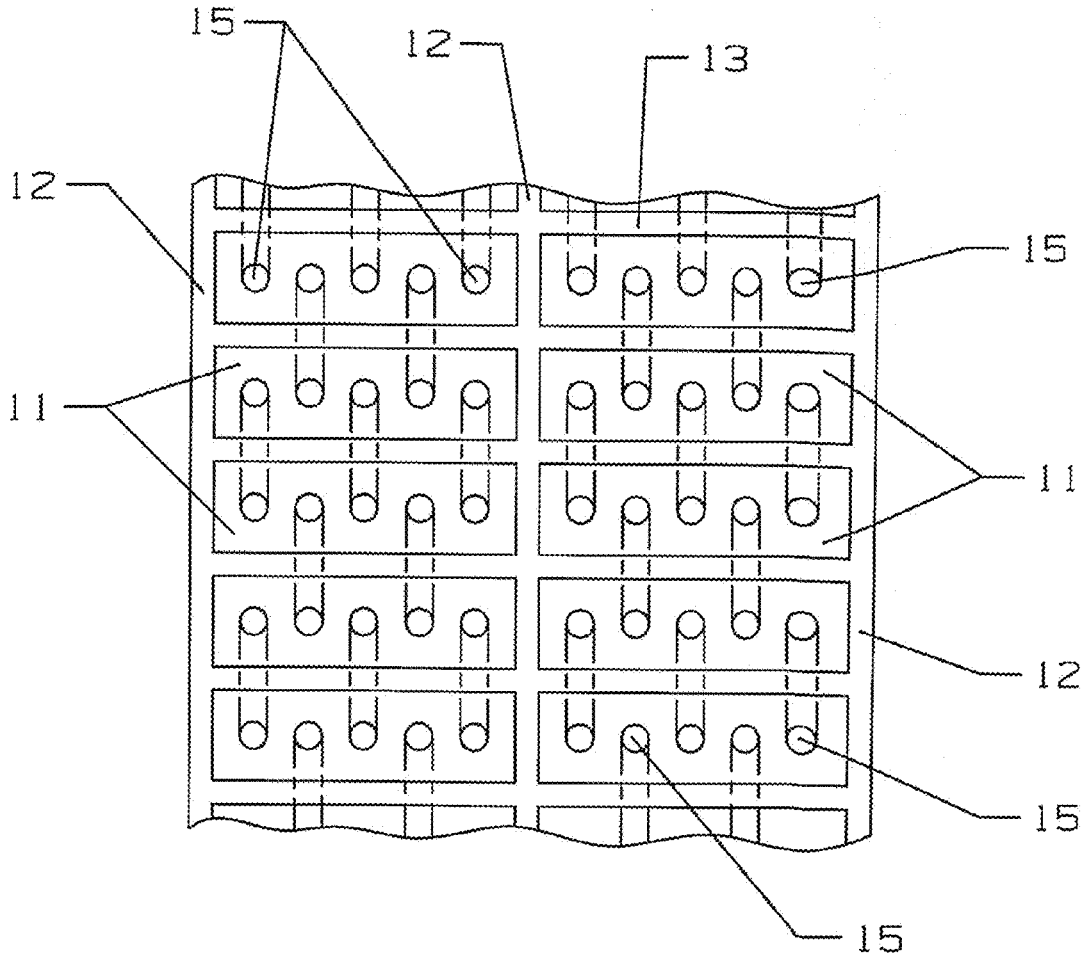
FIG. 2 shows a cross section side view of a section of the airfoil of the present invention with a series of multiple impingement cooling cavities and impingement cooling holes of the airfoil in present invention.

FIG. 2 shows a section of the pressure side wall of the blade with two spanwise rows of impingement cavities that extend from the platform section of the blade to the blade tip section and from the leading edge region to the trailing edge region. The width and height of the impingement cavities can vary depending upon the cooling capability and the amount of cooling for the airfoil wall required. As seen in FIG. 2, each impingement cavity 11 is rectangular in shape with the width being much more than the height. Each impingement cavity 11 is separated by a radial rib 12 and a chordwise rib 13. Both the pressure side wall and the suction side wall have rows of these spanwise extending impingement cavities.

Each impingement cavity 11 is connected to the adjacent cavities in the radial or spanwise direction by a number of curved impingement cooling holes 15 that connect the lower impingement cavity to the adjacent upper impingement cavity 11. The curved impingement holes 15 are also staggered as seen in FIG. 2 in which the curved cooling holes that supply one impingement cavity is positioned between the curved cooling holes discharge impingement cavity.

Figure 3:
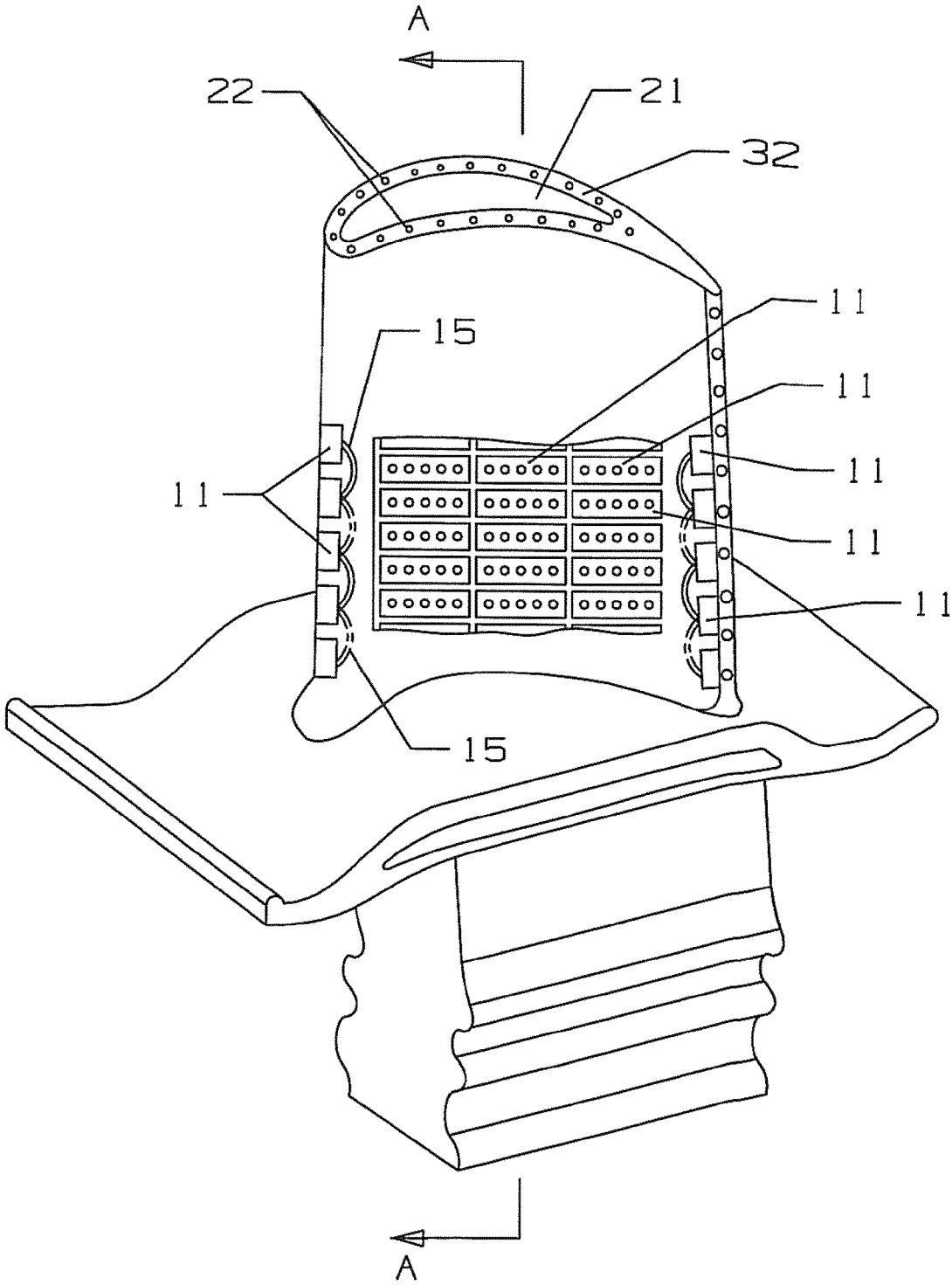
FIG. 3 shows a schematic view of the turbine blade with the impingement cooling cavities of the present invention with a cut-away section on the pressure side wall exposing the impingement cavities.
Figure 4:
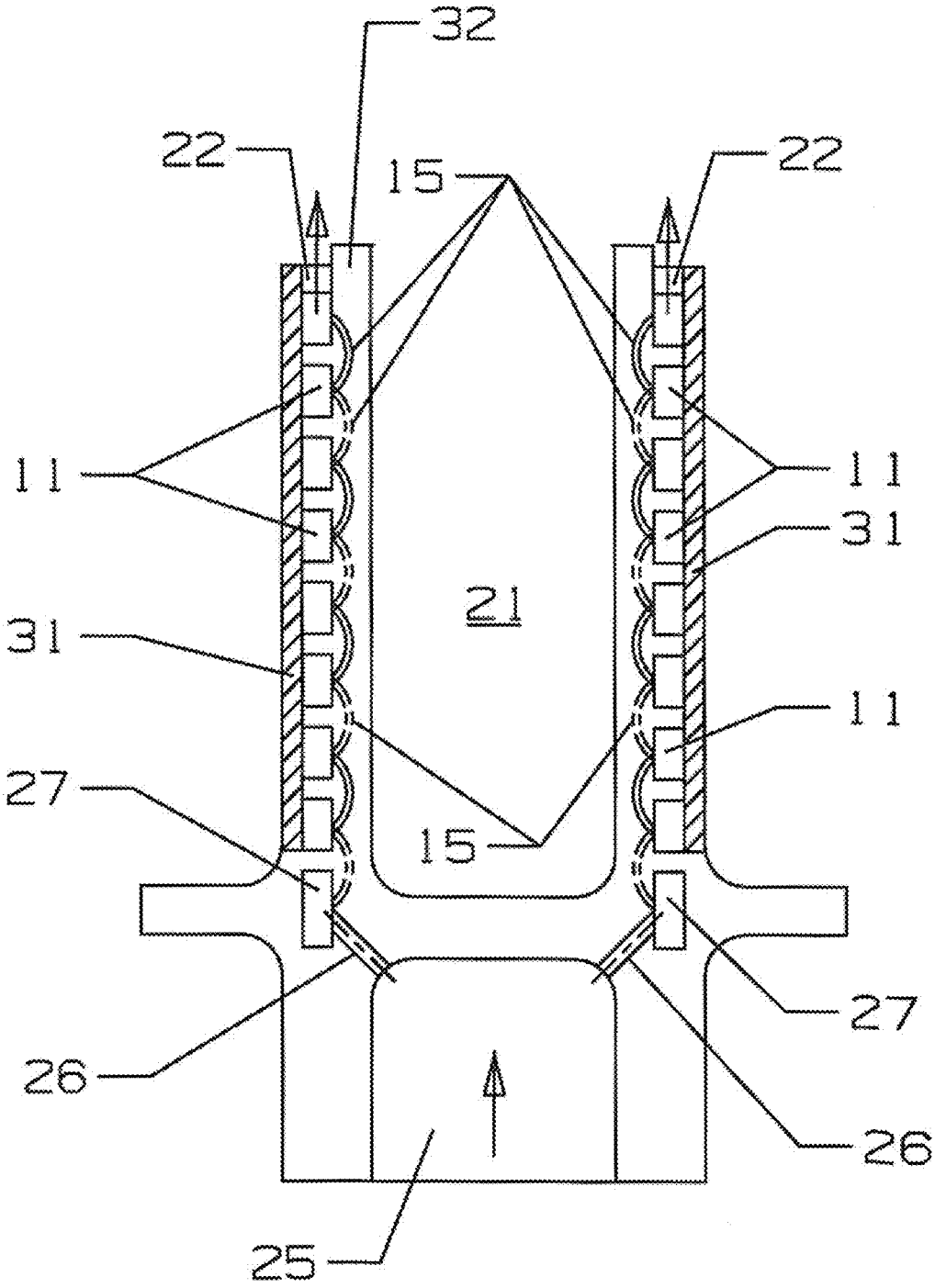
FIG. 4 shows a cross sectional view of the series of impingement cavities and curved impingement holes through a section of the pressure side wall and the suction side wall of the blade of FIG. 3.

FIG. 3 shows a schematic view of the turbine blade with a root section that includes a fir tree configuration for mounting the blade within a slot of the rotor disk, the platform and then the airfoil that extends to the tip. The airfoil is hollow 21 throughout the entire airfoil section and opens onto the tip section as seen in FIG. 4. As seen through the cut-away section in FIG. 3, the pressure side wall includes three rows of impingement cavities that extend from the platform region to the blade tip region and from the leading edge region to the trailing edge region to provide cooling along the entire pressure side wall of the airfoil. The suction side wall includes a similar arrangement of impingement cooling cavities. Both the leading edge region and the trailing edge region of the airfoil include a row of impingement cavities that extend from the platform to the tip. In the trailing edge row of impingement cavities, a row of trailing edge discharge holes are connected to provide cooling for the trailing edge of the airfoil. The curved impingement cooling holes 15 are clearly seen connecting the impingement cavities on the leading edge and trailing edge. The blade tip discharge cooling holes 22 are seen in FIG. 3 extend along the tip rails of the blade and discharge the cooling air from the last impingement cavities along the airfoil.

FIG. 4 shows a cross section view through a mid-chord region of the blade with the pressure side wall and the suction side wall of the spar shown. The spanwise series of impingement cavities 11 connected to the curved impingement cooling holes 15 is clearly seen in FIG. 4. The spar 32 is formed with the hollow mid-chord section 21 that is open at the blade tip. The spar 32 forms a main support structure for the thin thermal skin that is bonded to it to form the outer airfoil surface. The blade root includes one or more cooling supply cavities 25 that is connected to the external blade cooling air source. Supply cooling holes 26 connect the cooling air supply cavity 25 to the first in the series of impingement cooling cavities formed along the airfoil wall. Curved impingement cooling holes 15 then connect the series of impingement cavities according to the design shown in FIG. 2 except for the first impingement cavity which has the straight cooling supply holes 26. The last impingement cooling cavity 11 at the blade tip is connected to one or more tip cooling holes 22 that discharge the cooling air from the series of spanwise extending impingement cooling cavities. Film cooling holes can be used to provide a layer of film air to any surface of the airfoil that would require it. One or more rows of film cooling holes can be connected to certain ones of the impingement cavities to bleed off some of the cooling air through the film holes to provide film cooling for the outer airfoil surface. The row of spanwise extending impingement cooling cavities and curved impingement cooling holes also extend along the leading edge region and the trailing edge region.

To form the air cooled turbine blade of the present invention, the main support spar with the root and platform is formed as a single piece using the investment casing process form any suitable material such as nickel super-alloys. The cooling supply cavity 25 and the hollow mid-chord section are formed during the casting process along with the walls that form the support surfaces for the thin thermal skin. After this casing process, the rows of spanwise extending impingement cooling cavities 11 are machined into the spar, and then the curved impingement cooling holes are drilled or formed into the spar walls.

The thin thermal skin 31 is then bonded to the spar 32 to form the outer airfoil surface of the blade. The thin thermal skin can be one piece to cover the entire airfoil surface or a number of pieces that together cover the entire airfoil surface. the thin thermal skin 31 can be made from the same or a different material than the spar and with a thickness of from around 0.010 inches to around 0.030 inches in order to allow for high heat transfer rates through the skin to keep the metal temperature relatively low. The thin thermal skin 31 can be bonded to the spar using the transient liquid phase (TLP) bonding process.

Each row of impingement cavities 11 can be sized and shaped to provide a desired amount of cooling for that section of the airfoil wall in order to maintain a desired metal temperature. The multiple near wall impingement cooling design of the present invention is constructed in a series of radial outflow formation. The individual impingement cooling cavities can be designed based on the airfoil gas side pressure distribution in the spanwise direction. The use of separate compartments of impingement cavities along the airfoil chordwise direction is also used for tailoring the gas side pressure variation in the chordwise direction. Also, each of the individual series of radial impingement cavities can be designed based on the airfoil local external heat load to achieve a desired local metal temperature. With the unique cooling circuit of the present invention, a maximum use of the cooling art for a given airfoil inlet gas temperature and pressure profile is achieved. The incremental multiple impingement of the cooling air in the chordwise arranged impingement cavities yields a higher internal convection cooling effectiveness than the single pass radial flow cooling channels used in the prior art Moore design for near wall cooling of the airfoil walls.

On operation, pressurized cooling air is supplied to the airfoil cooling supply cavity 25 located in the root or blade attachment section of the blade. The cooling air is then impinged through each of the individual multiple chordwise impingement cavities 11 to provide impingement and convection cooling to a backside surface of the thin thermal skin 31 and the spar walls. The multiple impingement cooling process is repeated from the blade root section to the blade tip depending upon how many impingement cavities are used in the series along the airfoil wall. Some of the cooling air passing through the series of impingement cavities is bled off through one or more rows of film cooling holes to provide film cooling for the airfoil outer wall surface. The remaining cooling air passes through the impingement cavities and is discharged at the blade tip peripheral section along the tip rails to provide cooling for the tip rails. A small portion of the spent cooling air is also discharged through a row of trailing edge cooling holes for the cooling of the trailing edge corner of the airfoil. These trailing edge cooling holes extend from the platform to the tip region as seen in FIG. 3.

In another embodiment in which film cooling holes would be needed, rows of film cooling holes can be formed in the thin thermal skin to form a transpiration cooling for the blade leading edge. This transpiration cooling can also be used for the blade mid-chord section and form a transpiration cooled blade.

Because the cooling air is impinged through the chordwise impingement cavities in series toward the blade tip, fresh cooling air is provide at the blade root section first which will enhance the blade HCF (high cycle fatigue) capability. The cooling air increases in temperature within the series of multiple impingement cooling cavities as the cooling air flows toward the tip and thus induces a hotter metal temperature at the upper blade span. However, the pull stress at the blade upper span is low and the allowable blade metal temperature is high. This achieves a balanced thermal design.

Major design features and advantages of the multiple series of impingement cooling cavities over the prior art radial channel flow cooling are described below. The spar trust core is used to carry the blade loading and retain the structural integrity for a large industrial gas turbine blade. Elimination of casting with the use of ceramic cores for the cooling features and a simplified manufacture process and increased casting yields for a rotor blade is achieved. The multiple impingement cooling cavities provides cooling throughout the entire airfoil surface. The near wall cooling with a thin thermal skin will improve the blade cooling effectiveness by reducing the conduction path and lower the thermal gradient across the airfoil wall. Multiple use of the cooling air is also achieved. The total cooling air provides multiple incremental impingement cooling for the airfoil wall which is then discharged through the tip edge for peripheral cooling of the blade tip. This multiple use for the cooling air yields a very high overall blade cooling effectiveness. The spar structure with built in curved cooling holes is sued for the impingement cooling. The change in cooling momentum due to a change in cooling flow direction will generate a high rate of heat transfer for the spar structure.

The cooling circuit design of the present invention yields a lower and more uniform blade section mass average temperature at a lower blade span height which improves the blade creep life capability, especially creep at the lower blade span which is a very important design issue for a large industrial gas turbine blade.

The cooling circuit design of the present invention is inline with the blade creep design requirements. The cooling air increases in temperature in the series of impingement cooling cavities as the cooling air flows toward the tip which will induce a hotter sectional mass average temperature as the upper blade span. However, the pull stress at the blade upper span is low and the allowable blade metal temperature is high. This achieves a balanced thermal design for the blade.

The multiple impingement cooling cavities are also used in the airfoil leading and trailing edge regions for cooling. The cooling flow is initiated at the blade root section in order to provide a cooler blade leading and trailing edge corner which will enhance the blade HCF capability.

I claim the following:

1. An air cooled turbine rotor blade comprising:

a spar forming a main support structure for the blade;

the spar having a leading edge and a trailing edge wall, and a pressure side wall and a suction side wall extending between the leading and trailing edge walls and forming a hollow airfoil with an open tip;

a row of impingement cooling cavities extending in a spanwise direction of the airfoil from a root section to a blade tip section;

the row of impingement cooling cavities being connected in series with a plurality of impingement cooling holes that connect adjacent impingement cooling cavities; and, a plurality of blade tip cooling holes connected to a last impingement cooling cavity.

2. The air cooled turbine rotor blade of claim 1, and further comprising:

the plurality of impingement cooling holes being curved impingement cooling holes.

3. The air cooled turbine rotor blade of claim 2, and further comprising:

the curved impingement cooling holes are staggered such that curved holes leading into an impingement cavity are offset from curved holes that lead out from the impingement cavity.

4. The air cooled turbine rotor blade of claim 1, and further comprising:

the row of impingement cooling cavities are enclosed by an outer airfoil surface.

5. The air cooled turbine rotor blade of claim 4, and further comprising:

the outer airfoil surface is a thin thermal skin bonded to the spar.

6. The air cooled turbine rotor blade of claim 1, and further comprising:

the pressure side wall and the suction side wall both include a plurality of rows of impingement cooling cavities that extends from a platform to the blade tip;

each row of impingement cooling cavities is connected in series with a plurality of impingement cooling holes; and, each row of impingement cooling cavities is connected to a blade tip rail by a plurality of tip cooling holes.

7. The air cooled turbine rotor blade of claim 6, and further comprising:

the plurality of impingement cooling holes is curved impingement cooling holes.

8. The air cooled turbine rotor blade of claim 7, and further comprising:

the curved impingement cooling holes are staggered such that curved holes leading into an impingement cavity are offset from curved holes that lead out from the impingement cavity.

9. The air cooled turbine rotor blade of claim 5, and further comprising:

the spar and the root and the platform and the tip rails are formed as a single piece.

10. The air cooled turbine rotor blade of claim 5, and further comprising:

the thin thermal skin has a thickness in a range of 0.010 inches to 0.030 inches.

11. The air cooled turbine rotor blade of claim 6, and further comprising:

the impingement cooling cavities have a rectangular shape with a height much less than a width.

12. The air cooled turbine rotor blade of claim 6, and further comprising:

a row of impingement cooling cavities along the leading edge region of the airfoil each connected in series by a plurality of curved impingement cooling holes.

13. The air cooled turbine rotor blade of claim 6, and further comprising:

a row of impingement cooling cavities along the trailing edge region of the airfoil each connected in series by a plurality of curved impingement cooling holes; and, a row of trailing edge exit holes connected to the row of trailing edge impingement cavities.

14. The air cooled turbine rotor blade of claim 6, and further comprising:

a row of film cooling holes connected to a series of impingement cavities to discharge some of the cooling air as film cooling air for the outer airfoil wall.

15. The air cooled turbine rotor blade of claim 6, and further comprising:

the rows of impingement cooling cavities on the pressure side wall and the suction side wall are closed cooling passages such that all of the cooling air that enters the row of impingement cooling cavities is discharged through the blade tip cooling holes that are connected to the row.

16. The air cooled turbine rotor blade of claim 6, and further comprising:

the tip cooling holes open onto the blade tip outside of the tip rail and extend around the tip rail on both pressure and suction side walls and the leading edge region of the tip rail.

17. The air cooled turbine rotor blade of claim 1, and further comprising:

a row of film cooling holes connected to the row of impingement cooling cavities to discharge some of the cooling air as film cooling air for the outer airfoil wall.

* * * * *